United States Patent [19]

Porter

[11] 4,078,795

[45] Mar. 14, 1978

[54] TENSION CABLE ENCLOSURE

[76] Inventor: Douglas M. Porter, Colby Rd., Ipswich, Mass. 01938

[21] Appl. No.: 721,195

[22] Filed: Sep. 8, 1976

[51] Int. Cl.[2] ..... A63J 3/00

[52] U.S. Cl. ..... 272/3; 256/24; 256/27; 273/29 R

[58] Field of Search ..... 272/3; 273/29 R, 29 A, 273/29 B, 29 BA, 29 BB, 29 BC, 29 BD, 29 BE, 29 BF, 29 BG, 95 H, 26 A, 181 R, 181 A–181 K; 256/24, 27, 35, 36; 248/49; 52/83; 211/119.1; 135/5 R, 7.1 R, 7.1 A, 8, DIG. 3, DIG. 8

[56] References Cited

U.S. PATENT DOCUMENTS

| | | | |
|---|---|---|---|
| 696,520 | 4/1902 | Van Valkenburg | 256/35 |
| 1,017,833 | 2/1912 | White | 256/35 UX |
| 1,405,081 | 1/1922 | Whitney | 273/181 F |
| 1,496,482 | 6/1924 | Michod | 256/35 |
| 2,199,518 | 5/1940 | Coleman | 256/35 |
| 2,392,549 | 1/1946 | Rice | 248/49 UX |
| 2,823,034 | 2/1958 | Bingham, Jr. | 273/29 R X |
| 3,059,883 | 10/1962 | Matthiessen | 248/49 |
| 3,709,489 | 1/1973 | Holleran et al. | 272/3 X |
| 3,904,193 | 9/1975 | Patterson | 272/3 |
| 3,935,687 | 2/1976 | Vaughn et al. | 272/3 X |

FOREIGN PATENT DOCUMENTS

| | | | |
|---|---|---|---|
| 13,785 of | 1907 | United Kingdom | 273/29 BB |
| 407,462 | 3/1934 | United Kingdom | 273/29 BB |
| 1,013,136 | 12/1965 | United Kingdom | 273/29 BG |
| 1,038,836 | 8/1966 | United Kingdom | 273/29 BB |

*Primary Examiner*—Richard C. Pinkham
*Assistant Examiner*—Arnold W. Kramer
*Attorney, Agent, or Firm*—Morse, Altman, Oates & Bello

[57] ABSTRACT

An enclosure with barriers hung from tension cables that are suspended from corner supports, each of which includes a pair of compression members and a tensile member. The compression members of each pair are disposed obliquely with respect to their associated tensile member which is disposed vertically, the compression members and tensile member of each corner support converge at an apex from which the tension cable is suspended. One compression member of each corner support lies in a plane that is parallel to one side of the enclosure and the other compression members of that corner support lies in a plane that is parallel to an adjacent side of the enclosure, the associated tensile member being at the intersection of the two planes.

11 Claims, 5 Drawing Figures

30°
60°

TENSION CABLE ENCLOSURE

BACKGROUND OF THE INVENTION

1. Field of the Invention

The present invention relates to enclosures and, more particularly, is directed towards enclosures having suspended tension cables.

2. Description of the Prior Art

Enclosures of various configurations have been designed for surrounding open areas, for example recreational areas such as tennis courts, paddle tennis courts and the like. As shown in U.S. Pat. No. 3,383,108, a paddle tennis court is enclosed by a tightly woven wire fence which is held in place by suitable attachment to corner posts, intermediate posts, top rails and diagonal braces. The recent years there has been an increased demand for inexpensive enclosures due to the increased costs of labor and material required for erecting such enclosures. Enclosures with vertical compression members and outrigger tensile members for supporting a tension cable which carries a fence have been introduced with varying degrees of success.

SUMMARY OF THE INVENTION

It is an object of the present invention to provide a tension cable supporting enclosure which is economical to manufacture and is simply constructed and erected.

Another object of the invention is to provide an enclosure having a suspended tension cable which carries a barrier for enclosing an open area. According to the present invention, there is provided an enclosure having corner supports from which a tension cable is suspended. The tension cable surmounts a rectangular area and carries a barrier which encloses the area. Each corner support includes a pair of compression members and a tensile member. One of the compression member pairs of each corner support lies in a plane that is parallel to one side of the barrier and the other compression member of the pair lies in a plane that is parallel to an adjacent side of the barrier. The tensile member is disposed vertically at the intersection of the two planes. The compression members are disposed in a path that is oblique with respect to the tensile member and converge upwardly and inwardly towards the tensile member.

Other objects of the present invention will in part be obvious and will in part appear hereinafter.

The invention accordingly comprises the apparatuses and systems, together with their parts, elements and interrelationships that are exemplified in the following disclosure, the scope of which will be indicated in the appended claims.

BRIEF DESCRIPTION OF THE DRAWINGS

A fuller understanding of the nature and objects of the present invention will become apparent upon consideration of the following detailed description taken in connection with the accompanying drawings, wherein.

DETAILED DESCRIPTION OF THE PREFERRED EMBODIMENTS

Figure 1:
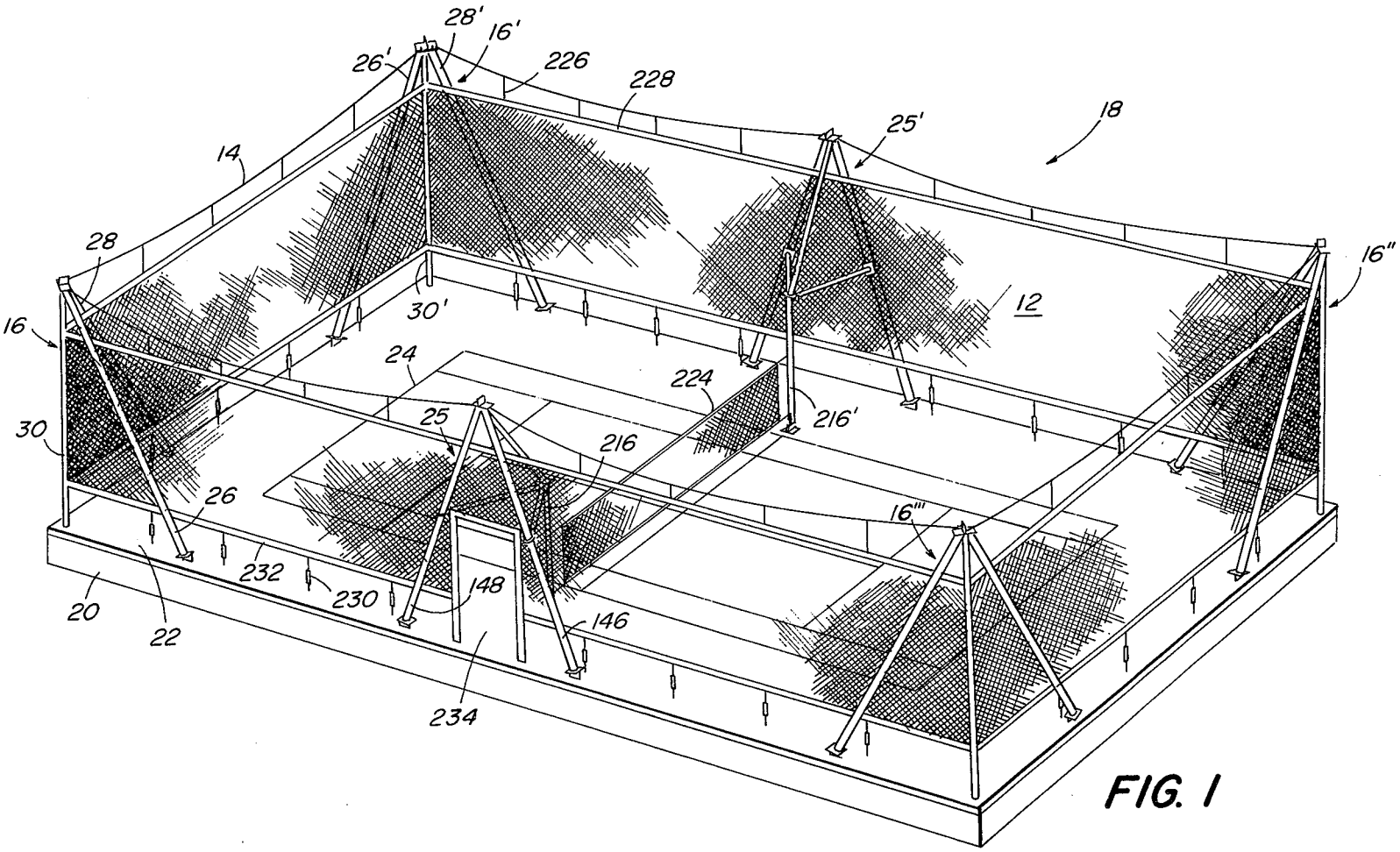
FIG. 1 is a perspective view of an enclosure embodying the invention about a paddle tennis court.
Figures 2, 3, 4, 5:
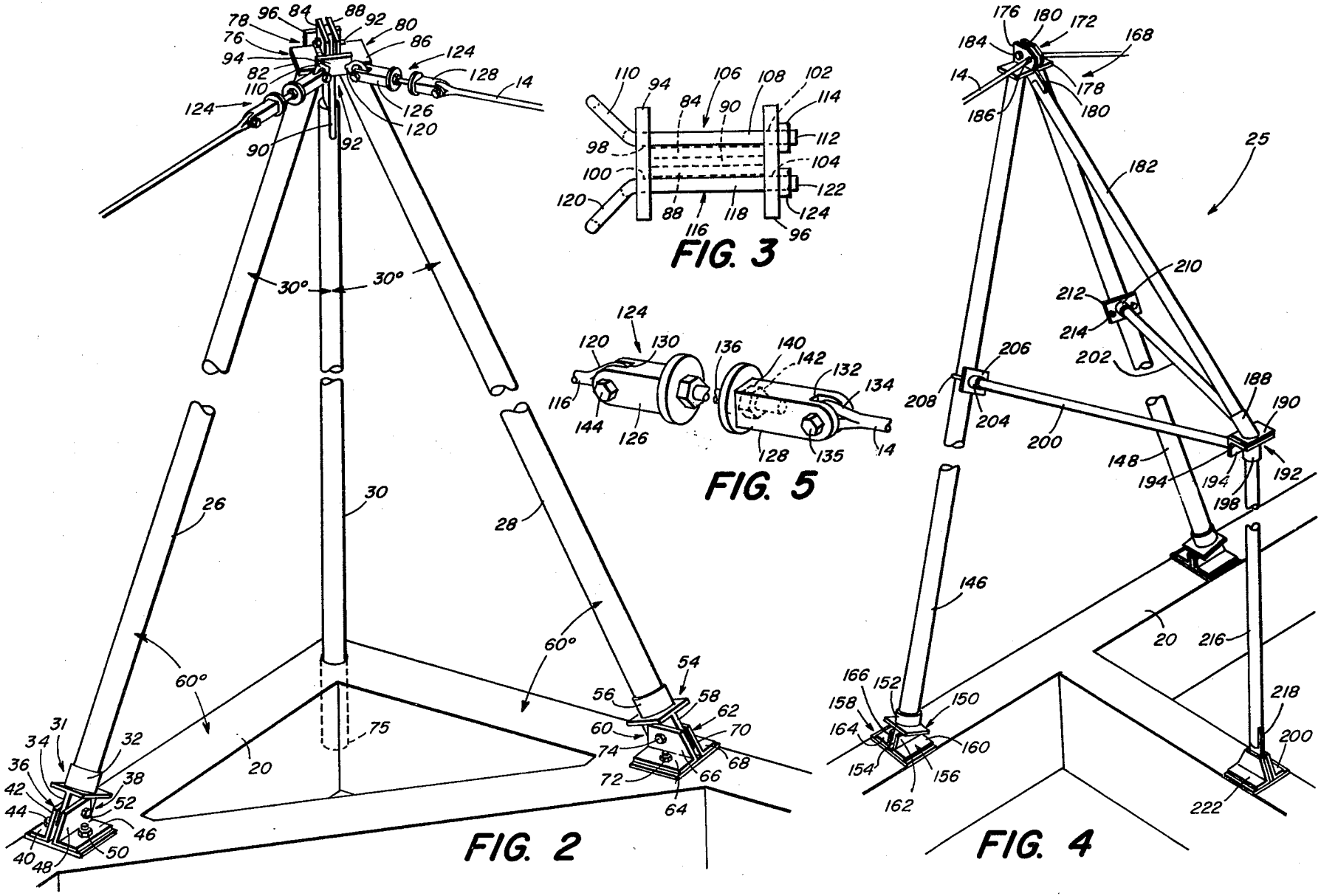
FIG. 2 is a perspective view of the corner supports of FIG. 1.
FIG. 3 is a plan view of the clamp on the corner supports from which the tension cables are suspended.
FIG. 4 is a perspective view of the intermediate supports of FIG. 1.
FIG. 5 is a perspective view of an anchor for securing the tension cables to the corner supports.

Referring now to the drawings, particularly FIG. 1, there is shown an enclosure 10 with vertically disposed barriers 12 that are carried by tension cables 14 which are suspended from corner supports 16. In the illustrated embodiment, by way of example, tension cables 14 surmount a rectangular recreational area 18 that is sixty feet by thirty feet, tension cable being a one half inch steel cable. Corner supports 16 are mounted at the corners of a rectangular foundation 20 that corresponds to recreational area 18. Foundation 20 supports a base 22 or playing surface for an athletic event such as paddle tennis. Playing surface is marked with indicia 24 that outlines a paddle tennis court having the dimensions of forty-four feet by twenty feet. Intermediate supports 25 are mounted to foundation 20 about the centerline of the long sides thereof, tension cables 14 are carried by the intermediate supports. The details of each corner support 16 and of each intermediate support are shown in FIGS. 2 and 4, respectively. It is to be understood that the corner supports are indentical in structure to one another and are mounted in an identical manner, the corner supports and corresponding parts thereof denoted by like reference and distinguished by prime notations. Similarly, the intermediate supports are identical in structure to each other and are mounted in an identical manner, the intermediate supports and their corresponding parts denoted by like reference characters and distinguished by prime rotations.

As shown in FIG. 2, each corner support 16 includes compression members 26, 28 and a tensile member 30. In the illustrated embodiment, compression members 26, 28 and tensile member 30 are composed of a metal such as steel, the compression members being three and one half inch steel pipes and the tensile member being one and one half inch steel pipe. Compression member 26 lies in a plane that is parallel to one side of enclosure 10 and compression member 28 lies in a plane that is parallel to an adjacent side of enclosure 10. Tensile member 30 is disposed vertically at the intersection of the planes in which compression members 26 and 28 lie. Compression members 26 and 28 lie in an oblique path with respect to tensile member 30, the compression members converging upwardly and inwardly from foundation 20 towards the upper end of the tensile member.

The lower end of compression member 26, which is threaded externally, is turned into a bracket 31 with an internally threaded socket 32 having an extending arm 34 which is held between a pair of L-shaped brackets 36, 38 that are mounted to foundation. Bracket 36 includes a substantially horizontal foot 40 and a substantially vertical leg 42, the foot being fastened to foundation 20 by a bolt 44. Bracket 38 includes a substantially horizontal foot 46 and a substantially vertical leg 48, the foot being mounted to foundation 20 by a bolt 50. Arm 34 is held between legs 42 and 48 by a bolt 52. Preferably, an angle of approximately 60° is formed between compression member 26 and foundation 20.

The lower end of compression member 28 is externally threaded and is turned into a bracket 54 having an internally threaded socket 56. An arm 58, which extends from bracket 54 opposite socket 56, is held between a pair of L-shaped brackets 60 and 62. Bracket 60 includes a substantially horizontal foot 64 and a substantially vertical leg 66. Bracket 62 includes a substantially horizontal foot 68 and a substantially vertical leg 70. Feet 64 and 68 are mounted to foundation 20 by means of bolts 72. Arm 58 is held between legs 66 and 70 by a bolt 74. Preferably, an angle of approximately 60° is formed between compression member 28 and foundation 20. The connection between arm 34 and brackets 36, 38, and the connection between arm 58 and brackets 60, 62 is such that compression members 26 and 28 are pivotally mounted for adjustment and alignment. The lower end of tensile member 30 is snugly received within an opening 75 that is formed at the corner of foundation 20.

As previously indicated, compression members 26 and 28 converge upwardly and inwardly from foundation 20 toward tensile member 30. The upper ends of compression members 26, 28 and tensile member 30 are held together in a clamp 76 having a pair of interconnected L-shaped brackets 78 and 80. Bracket 78 includes a substantially horizontal foot 82 and a substantially vertical leg 84. Compression member 26 is secured to foot 82 by welding, for example. Bracket 80 includes a substantially horizontal foot 86 and a substantially vertical leg 88. Compression member 28 is secured, by welding for example, to foot 86. A bar 90, which is fastened to the upper end of tensile member 30, extends upwardly and is received between legs 84 and 86. A bolt 92 that extends between legs 84, 86 secures bar 90 and clamps together compression members 26, 28 and tensile member 30. Preferably, an angle of approximately 30° is formed between tensile member 30 and each of compression members 26, 28. A clamp 92 is provided for suspending tension cables 14 from corner supports 16.

Clamp 92, as shown in FIG. 3, includes a pair of bars 94 and 96 that are formed with through holes 98, 100 and 102, 104, respectively. Bars 94 and 96 are placed against opposite side edges of legs 84, 88 and bar 90. An eye bolt 106, which includes a body 108 in the form of a rod that terminates in an offset ring or eye 110 at one end and is threaded at an opposite end 112, is inserted through holes 98 and 102. A nut 114 is turned onto threaded portion 112. An eyebolt 116, which includes a body 118 in the form of a rod that terminates in an offset ring or eye 120 at one end and is threaded at an opposite end 122, is inserted through holes 100 and 104. As best shown in FIG. 2, eyes 110 and 120 are disposed on the same face of bar 94, eye 110 directed towards compression member 26 and eye 120 directed towards compression member 28. Tension cables 14 are connected to eyebolts 106 and 116 by means of anchors 124.

As best shown in FIG. 5, each anchor 124 includes a pair of yokes 126 and 128, each of which is formed with U-shaped openings 130 and 132. The ends of each tension cables 14 are provided with an eye 134 that is received within opening 132. A nut and bolt assemblage 135 holds eye 134 to yoke 128. A threaded stud 136 extends from an end of yoke 126 opposite U-shaped opening 130, a nut 138 being turned onto stud 136. An opening 140 formed in an end of yoke 128 opposite U-shaped opening 132 is configured to receive threaded stud 136, a nut 142 being turned onto the end of stud 136 within opening 140. U-shaped opening 130 is configured to receive eye 120, a nut and bolt assemblage 144 secures eyebolt 116 to yoke 126. The arrangement of yokes 126 and 128 is such that the tension of cable 14 is adjustable by moving the yokes towards and away from each other on threaded stud 136. An identical anchor is provided for attaching tension cable 14 to eyebolt 106.

In the illustrated embodiment, there is a corner support 16 at each corner of rectangular foundation 20. One tension cable 14 is suspended between adjacent ones of corner supports 16. Tension cables 14 that are suspended between corner supports 16 bounding the short sides of foundation 20 lie in a catenary path. Tension cables 14 that are suspended between corner supports 16 bounding the long sides of foundation 20 are carried by intermediate supports 25, the tension cables lying in a catenary path between the corner supports and the intermediate supports disposed between the corner supports.

Referring now to FIG. 4, it will be seen that each intermediate support 25 includes a pair of columns 146 and 148, for example three and one half inch pipes, that lie in a plane that is parallel to the long side of enclosure 10. The lower end of column 146 is externally threaded and is turned into a bracket 150 having an internally threaded socket 152. An arm 154, which extends from bracket 150 is held between a pair of L-shaped brackets 156 and 158. Bracket 156 includes a substantially horizontal foot 160 and a substantially vertical leg 162. Bracket 158 includes a substantially horizontal foot 164 and a substantially vertical leg 166. Feet 160 and 164 are bolted to foundation 20 and arm 154 is held between legs 162 and 166 by a bolt (not shown). Column 148 is secured to foundation 20 in an identical manner as described in connection with the mounting of column 146 to the foundation. Columns 146 and 148 converge upwardly and inwardly from foundation 20 and are joined together at their upper ends in a clamp 168.

Clamp 168 includes a pair of interconnected L-shaped brackets 170 and 172. Bracket 170 includes a substantially horizontal foot 174 and a substantially vertical leg 176. Column 146 is fastened to foot 174 by welding, for example. Bracket 172 includes a substantially horizontal foot 178 and a substantially vertical leg 180. Column 148 is secured by welding, for example, to foot 178. A bar 180, which is mounted to an arm 182, is received between legs 176, 180 and held therebetween by a nut and bolt assemblage 184. Tension cable 14 is threaded through holes 186 that are provided in legs 176 and 180.

The free end of arm 182 is externally threaded and is turned into an internally threaded socket 188 that is mounted to a flange 190. An L-shaped bracket 192 having a substantially horizontal base 194, a downwardly extending leg 196 and a downwardly extending, internally threaded socket 198 is bolted to flange 190, base 194 and flange 190 being in face-to-face relationship. A pair of cross members 200 and 202 are connected between leg 196 and columns 146 and 148, respectively. One end of cross member 200 is fastened to leg 196 and the other end of cross member 200, which is externally threaded, is turned into an internally threaded socket 204. Socket 204 is mounted to a flange 206 which is secured to column 146 by a U-bolt 208. One end of cross member 202 is mounted to leg 196. The other end of cross member 202 is externally threaded and is turned into an internally threaded socket 210 which is mounted on a flange 212. Flange 212 is connected to column 148 by a U-bolt 214. One end of a vertically disposed post 216 is turned into threaded socket 198. A bar 218, which extends downwardly from the other end of post 216, is mounted to foundation 20 by a pair of interconnected L-shaped brackets 220 and 222. In the illustrated embodiment, arm 182, cross members 200 and 202, and post 216 are one and one half inch steel pipes.

Referring again to FIG. 1, it will be seen that a net 224, which is positioned at the center of the paddle tennis court, is connected between posts 216 and 216' of opposing intermediate supports 25 and 25', respectively. Barriers 12, for example woven nets composed of sixteen gage galvanized steel and having one inch hexagonal openings, are hung from tension cables 14 by means of eyebolts 226 that are secured to strips 228 mounted to the upper edge of woven nets 12. Adjustable tension devices 230, for example turnbuckles, secure the lower edge of woven nets 12 to foundation 20. Turnbuckles 230 are connected to strips 232 that are mounted to the lower edge of the woven nets 12, the tension on woven nets 12 being controlled by adjusting turnbuckles 230. Woven nets 12 are disposed in vertical planes and constitute the sides of enclosure 10. Access to playing area 22 is provided through a doorway 234 that is located between columns 146 and 148.

Since certain changes may be made in the foregoing disclosure without departing from the scope of the invention herein involved, it is intended that all matter contained in the above description and depicted in the accompanying drawings be construed in an illustrative and not in a limiting sense.

What is claimed is:

1. An enclosure comprising:

(a) a rectangular base;

(b) a plurality of supports disposed about an area to be enclosed, one of each said supports mounted to said base at one corner thereof each said support including a pair of compression members and a tensile member, said compression members of each said pair disposed obliquely with respect to their associated tensile member which is disposed vertically, lower ends of said compression members and said tensile member of each said support secured to said base;

(c) a plurality of adjustable horizontal tension means connected to said supports;

(d) tension cable means suspended in a catenary path between adjacent ones of said corner supports by said horizontal tension means, said tension cable means surmounting the area to be enclosed; and (e) a plurality of adjustable vertical tension means;

(f) a plurality of barrier means suspended in tension between said tension cable means and said rectangular base in a vertical plane between adjacent one of said corner supports by said vertical tension means, said corner supports disposed outside the area bounded by said barrier means;

(g) one of said compression members pairs of any one of said corner supports disposed in a first plane that is parallel to one side of the enclosure, the other of said compression member pair disposed in a second plane that is parallel to an adjacent side of the enclosure, said first plane intersecting said second plane, said tensile member of said one corner support disposed at the intersection of said planes.

2. The enclosure as claimed in 1 including a plurality of fastening means, said one compression member and said other compression member of each support converging upwardly and inwardly from said base towards said tensile member of said support, one of said each said fastening means at the convergence of said compression and tensile members of each said support for securing said compression and tensile members against relative movement, said tension cable means secured to said fastening means by said horizontal tension means.

3. The enclosure as claimed in claim 2 including means for securing said compression member and said tensile members to said base, an angle of approximately thirty degrees formed between each said compression member and its associated tensile member.

4. The enclosure as claimed in claim 1 wherein said barrier means is a mesh screen.

5. The enclosure as claimed in claim 4 an upper binder attached to an upper margin of said mesh screen and a lower binder attached to a lower margin of said mesh screen, said upper binder operatively connected to said tension cable means by certain ones of said vertical tension means, said lower binder operatively connected to said base by certain ones of said vertical tension means.

6. The enclosure as claimed in claim 5 wherein each said horizontal tension means includes a pair of interconnected yokes, one of each said yoke pair connected to one of each said fastening means, the other of each said yoke pair connected to said tension cable means.

7. An enclosure for a paddle tennis court, said enclosure comprising:

(a) a rectangular foundation;

(b) a base having indicia thereon outlining a paddle tennis court, said base supported by said foundation;

(c) a plurality of corner supports spaced from said indicia, said corner supports mounted to said foundation, each said corner support including a pair of compression member and a tensile member, said compression members disposed obliquely with respect to their associated tensile member which is disposed vertically;

(d) a bracket for each of said corner supports, upper ends of said compression members and tensile member of each said corner support held in fixed relationship to one another by their associated bracket;

(e) a pair of adjustable horizontal tension means attached to each said bracket;

(f) tension cable means suspended in a catenary path between adjacent corner supports by said horizontal tension means, said tension cable means surmounting an area about said paddle tennis court; and (g) a plurality adjustable turnbuckles;

(h) a mesh screen suspended in tension between said tension cable means and said foundation in a vertical plane between said corner supports, by said turnbuckles, said mesh screen bounding a rectangular area, said corner supports disposed outside the area bounded by said mesh screen;

(i) one of said compression member pairs of each corner support disposed in a first plane that is parallel to one side of said bounded rectangular area, the other of said compression member pair disposed in a second plane that is parallel to an adjacent side of said bounded rectangular area, said first plane intersecting said second plane, said tensile member associated with said compression member pair of said each corner support disposed at the intersection of said first and second planes.

8. The enclosure as claimed in claim 7 wherein said one compression member and said other compression member converge inwardly and upwardly from said foundation towards their associated tensile member, upper ends of each of said compression members and associated tensile members held together by said brackets.

9. The enclosure as claimed in claim 8 including a pair of intermediate supports and an intermediate bracket for each said pair of intermediate supports, each said intermediate support disposed at a medial portion on opposite long sides of said bounded rectangular area, each said intermediate support including first and second compression members that are mounted to said foundation along a third plane parallel to a plane of said mesh screen on said long side, said first and second compression members converging inwardly and upwardly from said base to an apex, upper ends of said first and second compression members of each said intermediate support held in fixed relationship to one another by one of said intermediate brackets, each said intermediate bracket formed with a hole through which said tension cable is threaded.

10. The enclosure as claimed in claim 9 wherein each said intermediate support includes a first member which extends downwardly and outwardly from said apex at a centerline of said paddle tennis court indicia, a pair of horizontal cross members connected between said first member and said first and second compression members, a substantially vertical member connected between the union of said cross members and said first member and said foundation.

11. The enclosure as claimed in claim 10 including a net connected between said first members and extending across said tennis paddle court at said centerline.

* * * * *